US011383365B1

(12) United States Patent
Huang

(10) Patent No.: US 11,383,365 B1
(45) Date of Patent: Jul. 12, 2022

(54) SLEEVE INSTALLER

(71) Applicant: SHIFUKANG INDUSTRIAL.CO., LTD., Taichung (TW)

(72) Inventor: Shang-Yuan Huang, Taichung (TW)

(73) Assignee: SHIFUKANG INDUSTRIAL.CO., LTD., Taichung (TW)

( * ) Notice: Subject to any disclaimer, the term of this patent is extended or adjusted under 35 U.S.C. 154(b) by 0 days.

(21) Appl. No.: 17/130,323

(22) Filed: Dec. 22, 2020

(51) Int. Cl.
*B25B 27/06* (2006.01)

(52) U.S. Cl.
CPC ..... *B25B 27/062* (2013.01)

(58) Field of Classification Search
CPC ..... B25B 27/0028; B25B 27/0035; B25B 27/023; B25B 27/06; B25B 27/062; Y10T 29/53657; Y10T 29/53848; Y10T 29/53857; Y10T 29/53878; Y10T 29/53917; Y10T 29/53952; Y10T 29/53987
USPC ..... 29/258
See application file for complete search history.

(56) References Cited

U.S. PATENT DOCUMENTS 6,158,110 A * 12/2000 Takacs ..... B25B 27/062 29/259
2008/0273826 A1* 11/2008 Muller ..... B25B 27/062 384/609
2011/0302754 A1* 12/2011 Huang ..... B25B 27/062 29/260
2012/0036691 A1* 2/2012 Mueller ..... B25B 27/062 29/263
2014/0250650 A1* 9/2014 Lee ..... B25B 27/062 29/259

FOREIGN PATENT DOCUMENTS

GB 2476113 A * 6/2011 ..... B25B 27/064

* cited by examiner

*Primary Examiner* — Lee D Wilson
*Assistant Examiner* — Jacob Adam Montgomery
(74) *Attorney, Agent, or Firm* — Muncy, Geissler, Olds & Lowe, P.C.

(57) ABSTRACT

A sleeve installer is provided, including: a threaded rod; an abutting unit, disposed around and movable along the threaded rod, including first and second abutting assemblies, one of the first and second abutting assemblies being configured to be abutted against a barrel portion of a sleeve assembly, the other of the first and second abutting assemblies being configured to be abutted against a tubular member of the sleeve assembly; and a push unit, including first and second push members which are connected to two opposite ends of the threaded rod, at least one of the first and second push members being movably screwed to the threaded rod, the first push member including a head portion and an urging assembly located at a side of the head portion, the urging assembly and the second push member being respectively abutted against two opposite sides of the abutting unit.

10 Claims, 6 Drawing Sheets

SLEEVE INSTALLER

BACKGROUND OF THE INVENTION

Field of the Invention

The present invention relates to a sleeve installer.

Description of the Prior Art

It is quite common for components to be combined through sockets, especially for actuating components such as the combination of trailing arms and iron sleeves in the automotive field. Traditionally, a rubber hammer is usually used to strike the iron sleeve into the trailing arm.

However, the striking of the rubber hammer requires very skilled person to carry out. If the impact point is incorrect or the force level is not well controlled, it is easy to damage the iron sleeve, and the overall installation process will be too laborious and time-consuming Besides, the striking of the rubber hammer cannot be performed smoothly and effectively in a narrow working space.

The present invention is, therefore, arisen to obviate or at least mitigate the above-mentioned disadvantages.

SUMMARY OF THE INVENTION

The main object of the present invention is to provide a sleeve installer which is easy and quick to operate without damage.

To achieve the above and other objects, a sleeve installer configured to be applied to a sleeve assembly including a barrel portion and a tubular member configured to be inserted in the barrel portion is provided, including: a threaded rod, configured to be disposed through the sleeve assembly; an abutting unit, disposed around the threaded rod and movable along the threaded rod, including a first abutting assembly and a second abutting assembly located respectively at two opposite sides of the sleeve assembly, one of the first abutting assembly and the second abutting assembly being configured to be abutted against the barrel portion, the other of the first abutting assembly and the second abutting assembly being configured to be abutted against the tubular member; and a push unit, including a first push member and a second push member which are connected to two opposite ends of the threaded rod, at least one of the first push member and the second push member being movably screwed to the threaded rod, the first push member including a head portion and an urging assembly located at a side of the head portion, the urging assembly and the second push member being respectively abutted against two opposite sides of the abutting unit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
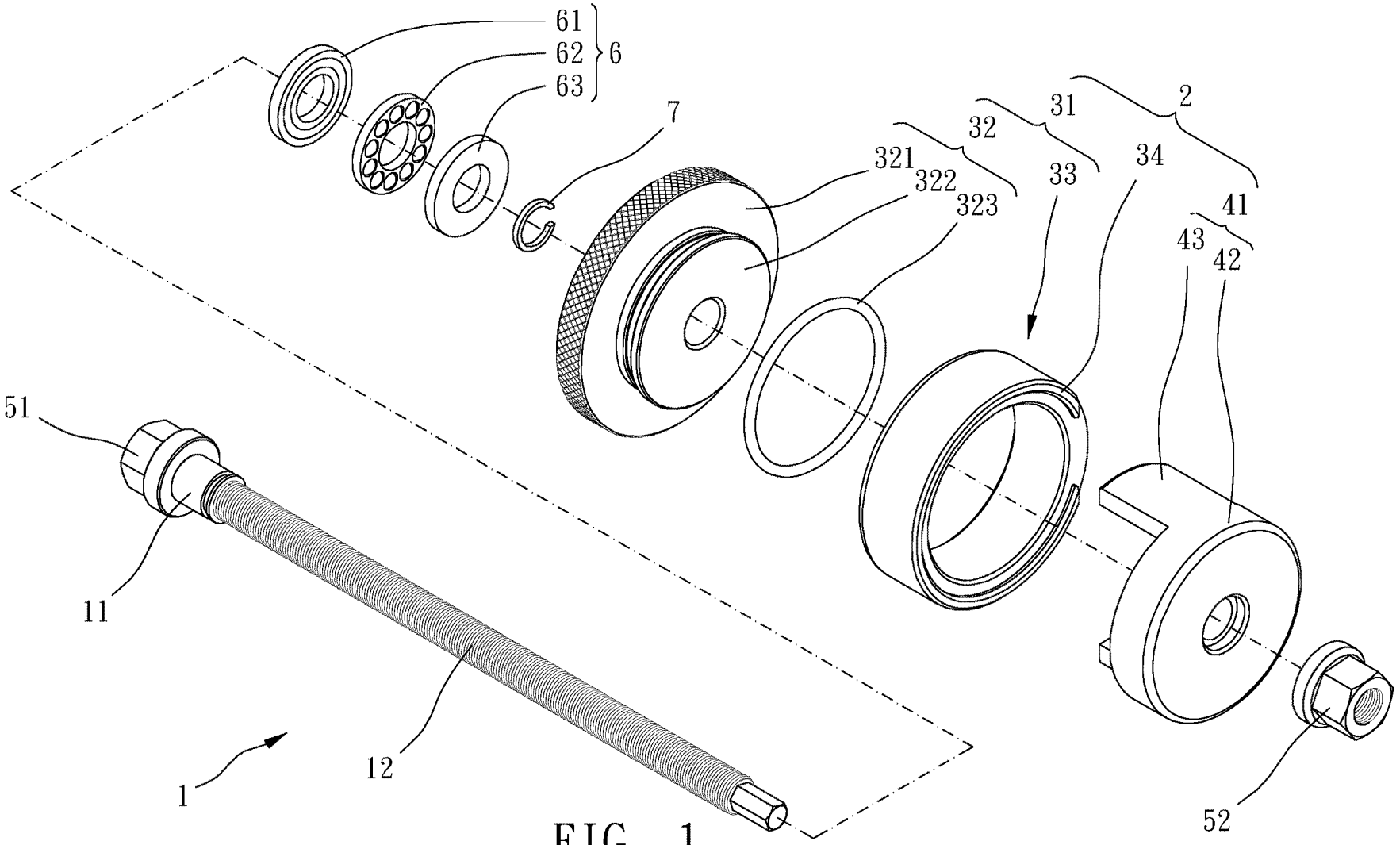
FIG. 1 is a breakdown drawing of a preferable embodiment of the present invention.
Figure 2:
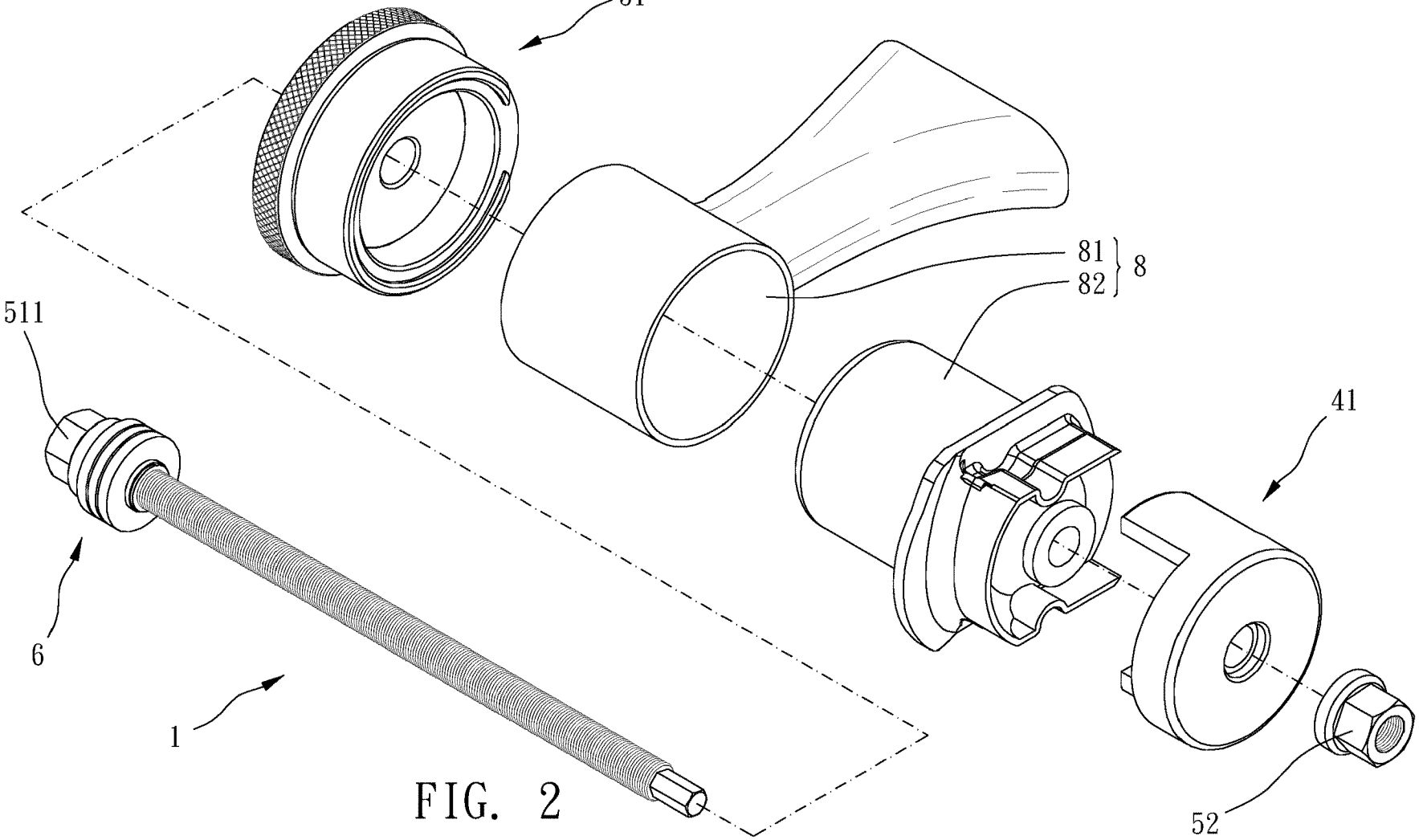
FIG. 2 is a drawing showing the application of a sleeve installer of a preferable embodiment of the present invention.
Figure 3:
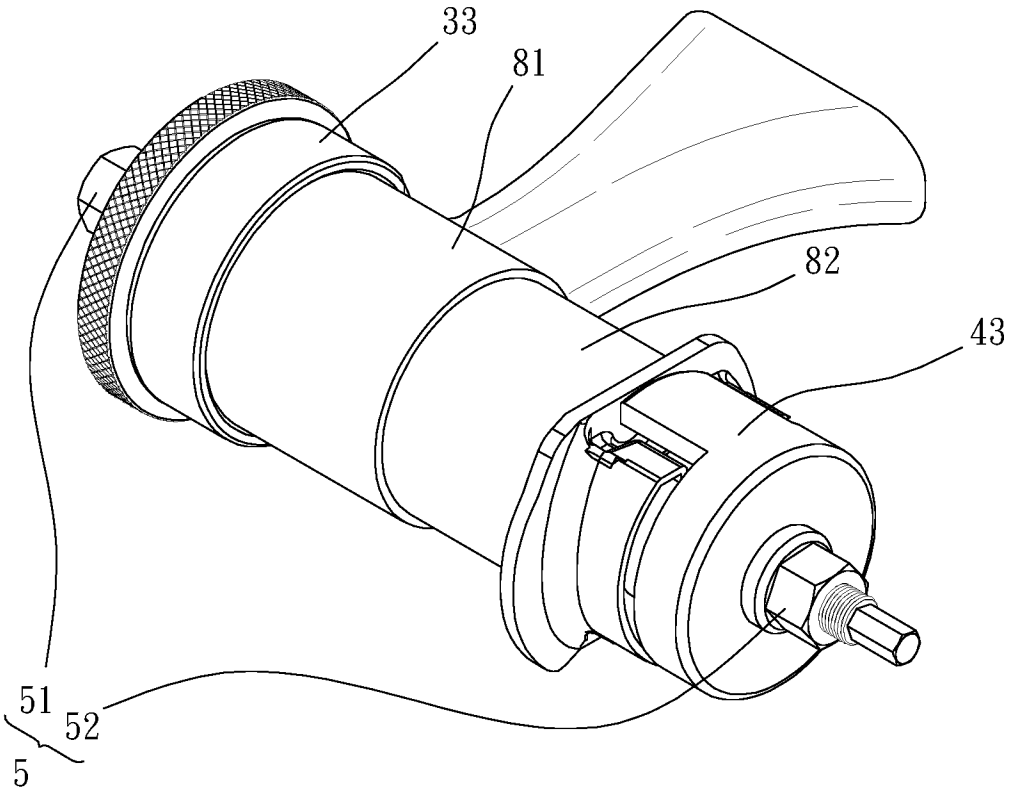
FIGS. 3 and 4 are drawings showing working and operation of the sleeve installer of a preferable embodiment of the present invention.
Figure 4:
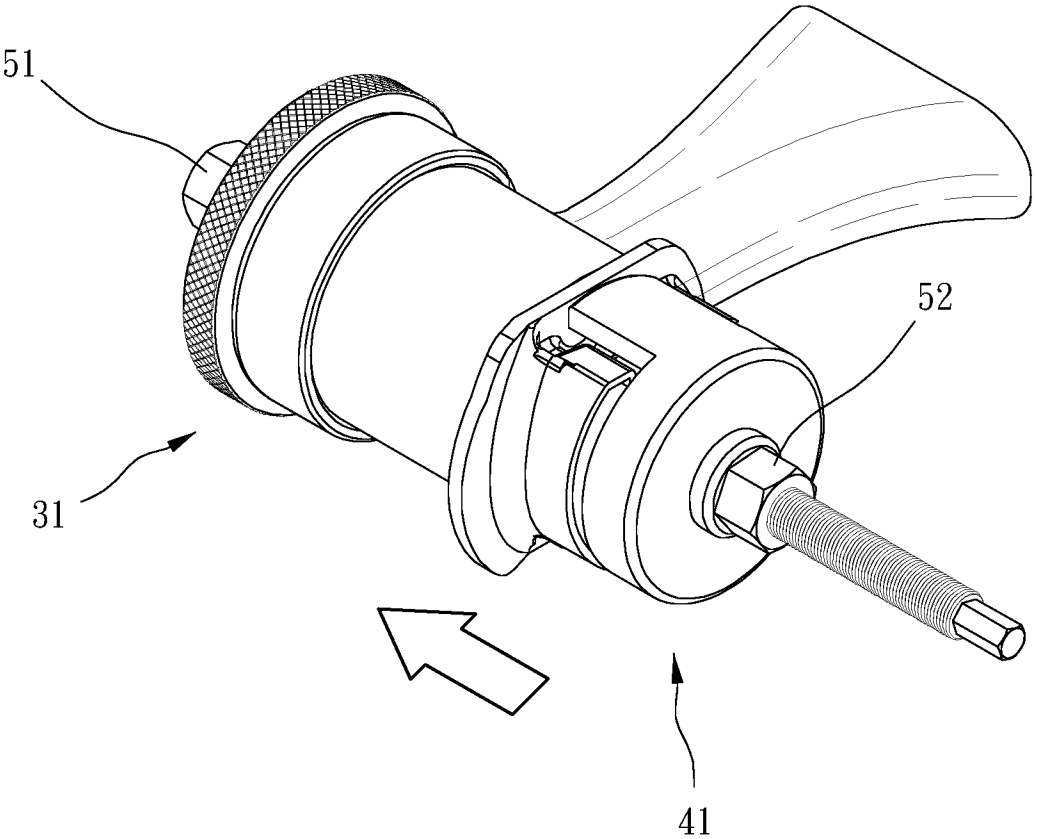
Figure 5:
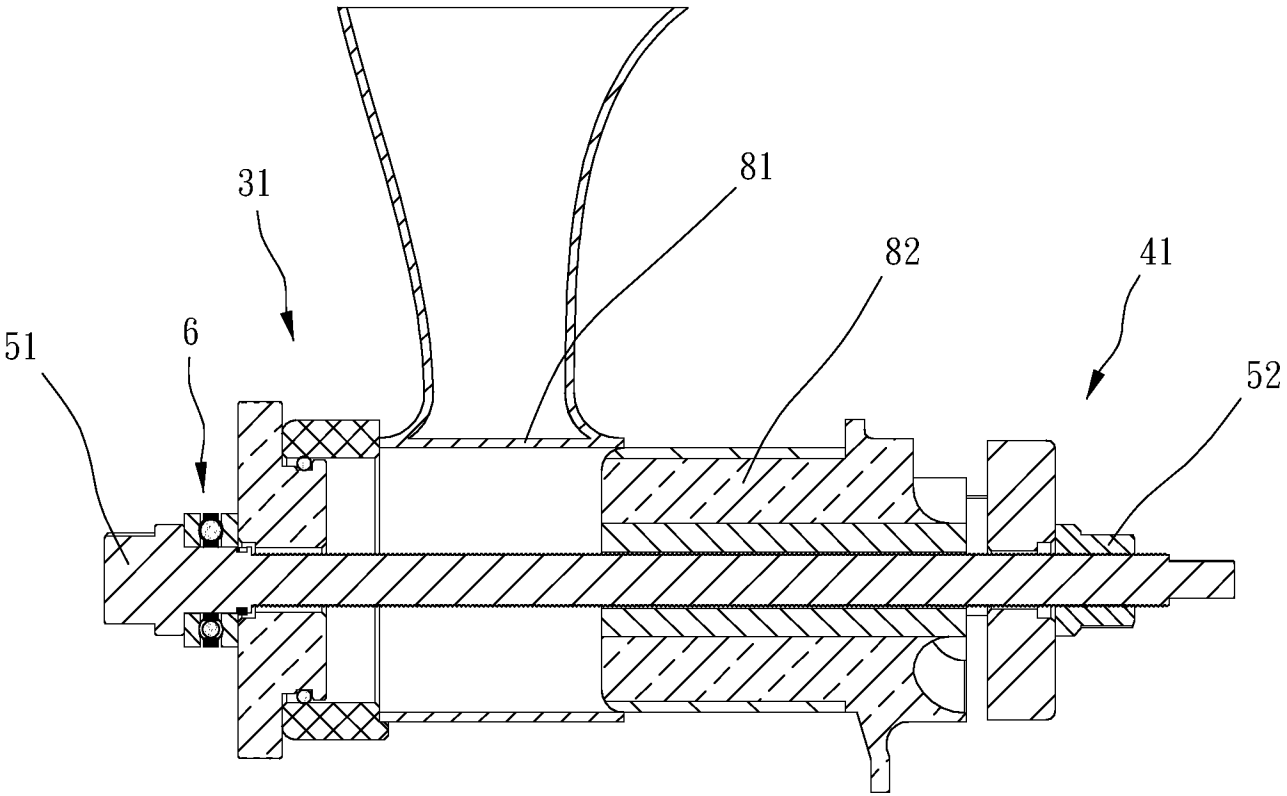
FIGS. 5 and 6 are cross-sectional views showing working and operation of the sleeve installer of a preferable embodiment of the present invention.
Figure 6:
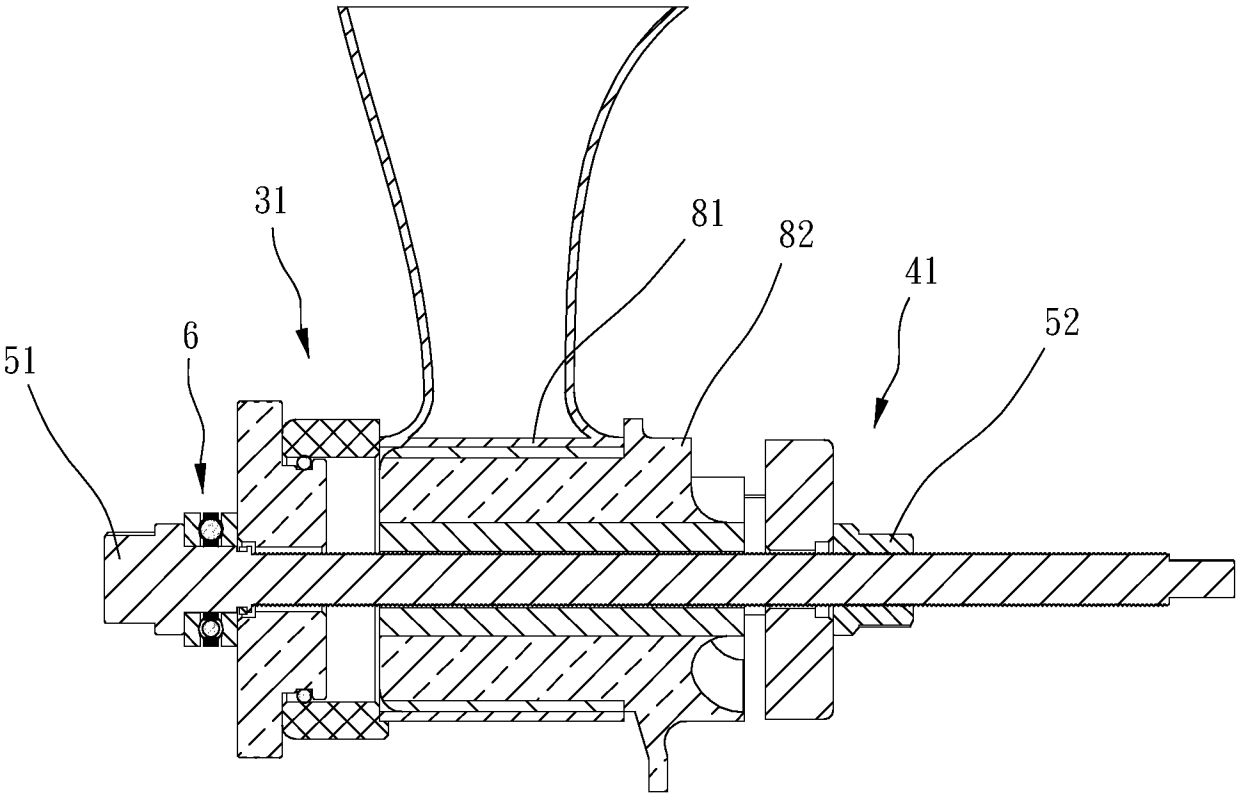

Please refer to FIGS. 1 to 6 for a preferable embodiment of the present invention. A sleeve installer of the present invention is configured to be applied to a sleeve assembly 8, and the sleeve assembly 8 includes a barrel portion 81 and a tubular member 82 configured to be inserted in the barrel portion 81, wherein the barrel portion 81 and the tubular member 82 are parts such as but are not limited to the trailing arm and the sleeve receiver connected with the trailing arm. The sleeve installer includes a threaded rod 1, an abutting unit 2 and a push unit 5.

The threaded rod 1 is configured to be disposed through the sleeve assembly 8. The abutting unit 2 is disposed around the threaded rod 1 and movable along the threaded rod 1. The abutting unit 2 includes a first abutting assembly 31 and a second abutting assembly 41 located respectively at two opposite sides of the sleeve assembly 8. One of the first abutting assembly 31 and the second abutting assembly 41 is configured to be abutted against the barrel portion 81, and the other of the first abutting assembly 31 and the second abutting assembly 41 is configured to be abutted against the tubular member 82.

The push unit 5 includes a first push member and a second push member 52 which are connected to two opposite ends of the threaded rod 1, and at least one of the first push member 51 and the second push member 52 is movably screwed to the threaded rod 1. In this embodiment, the first push member 51 includes a head portion 511 and an urging assembly located at a side of the head portion 511, the head portion 511 is fixedly connected to one of the two opposite ends of the threaded rod 1, and the second push member 52 is movably screwed to the other of the two opposite ends of the threaded rod 1. The urging assembly and the second push member 52 are respectively abutted against two opposite sides of the abutting unit 2. When the second push member 52 and the threaded rod 1 rotate relatively to shorten the distance between the first push member 51 and the second push member 52, the first push member 51 and the second push member 52 push the first abutting assembly 31 and the second abutting assembly 41 to approach each other so that the tubular member 82 is inserted into the barrel portion 81.

In this embodiment, the head portion 51 and the threaded rod 1 are integrally formed of one piece, and the head portion and the threaded rod 1 are formed by cutting, which can simplify the structure and assembling. However, the first push member may be screwed with the threaded rod 1.

Preferably, the urging assembly includes a bearing assembly 6 disposed between the abutting unit 2 and the push unit 5 between, which reduces the frictional resistance between the abutting unit 2 and the push unit 5 during relative rotation. It is noted that the urging assembly is optional, and the head portion may be directed abutted against the abutting unit; the bearing assembly 6 may be any spacing member or structure for urging the abutting unit.

Specifically, the bearing assembly 6 is mounted to the threaded rod 1 and rotatable in place, thus avoiding missing of the bearing assembly 6. In this embodiment, the bearing assembly 6 is disposed between the first push member 51 and the first abutting assembly 31, the bearing assembly 6 is radially higher than the first push member 51, which provides a large area for contact of the first push member 51.

Specifically, the threaded rod 1 further includes a non-threaded section 11 and a threaded section 12, the non-threaded section 11 is connected between the first push member 51 and the threaded section 12, the non-threaded section 11 is radially larger than the threaded section 12, the non-threaded section 11 is partially within the first abutting assembly 31, the second push member 52 is screwed to the threaded section 12, and the bearing assembly 6 is disposed around the non-threaded section 11. A restricting member 7 is positioned on the non-threaded section 11 so that the bearing assembly 6 is restricted axially on the threaded rod 1. In this embodiment, the restricting member 7 is a c-shaped retainer.

The bearing assembly 6 includes a first side disc 61, a middle disc 62 and a second side disc 63 which are arranged in an axial direction of the threaded rod 1, and the middle disc 62 is rotatably abutted between the first side disc 61 and the second side disc 63. The first abutting assembly 31 includes a first base portion 32 and a support member 33. The support member 33 is detachably assembled to the first base portion 32 for easy replacement, and the support member 33 is configured to be abutted against the sleeve assembly 8. A flange 34 projects from an end face of the support member 33 opposite to the first base portion 32. When the support member 33 is abutted against the barrel portion 81, the end face of the support member 33 is abutted against the barrel portion 81 in the axial direction of the threaded rod 1, and the flange 34 is abutted radially against the barrel portion 81, which provides stable combination of the support member 33 and the barrel portion 81 between.

Specifically, the first base portion 32 includes a base plate 321, a projection 322 and a fitting member 323 which are arranged coaxially, the projection 322 projects axially from the base plate 321, the fitting member 323 projects radially from the projection 322, and the support member 33 is disposed around the projection 322 and abutted radially against the fitting member 323, wherein the base plate 321 and the support member 33 are connected in tight fit.

Preferably, the fitting member 323 is made of rubber, thus being easy to assemble and avoiding easy disengagement of the support member 33.

Specifically, the second abutting assembly 41 includes a second base portion 42 and at least one wing 43, the at least one wing 43 is disposed on the second base portion 42 and extends in the axial direction of the threaded rod 1, and the at least one wing 43 is configured to be abutted against the tubular member 82, for sufficiently pushing the tubular member 82. In this embodiment, the at least one wing includes two wings 43 arranged symmetrically, for providing even push force.

It is noted that a through hole of the first base portion 32 and a through hole of the second base portion 42 are identical so that the threaded rod 1 can be disposed through the abutting unit 2 from either side of the abutting unit 2. In other words, the first push member 51 may be abutted against the first base portion 32 or the second base portion 42.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A sleeve installer, configured to be applied to a sleeve assembly, the sleeve assembly including a barrel portion and a tubular member configured to be inserted in the barrel portion, the sleeve installer including:

a threaded rod, configured to be disposed through the sleeve assembly;

an abutting unit, disposed around the threaded rod and movable along the threaded rod, including a first abutting assembly and a second abutting assembly located respectively at two opposite sides of the sleeve assembly, one of the first abutting assembly and the second abutting assembly being configured to be abutted against the barrel portion, the other of the first abutting assembly and the second abutting assembly being configured to be abutted against the tubular member; and a push unit, including a first push member and a second push member which are connected to two opposite ends of the threaded rod, at least one of the first push member and the second push member being movably screwed to the threaded rod, the first push member including a head portion and an urging assembly located at a side of the head portion, the urging assembly and the second push member being respectively abutted against two opposite sides of the abutting unit;

wherein a flange projects from an end face of a support member opposite to a first base portion, when the support member is abutted against the barrel portion, the end face is abutted against the barrel portion in an axial direction of the threaded rod, the flange is abutted radially against the barrel portion.

2. The sleeve installer of claim 1, wherein the first push member and the threaded rod are integrally formed of one piece.

3. The sleeve installer of claim 1, wherein the second abutting assembly includes a second base portion and at least one wing, the at least one wing is disposed on the second base portion and extends in the axial direction of the threaded rod, and the at least one wing is configured to be abutted against the tubular member.

4. The sleeve installer of claim 1, wherein the urging assembly includes a bearing assembly disposed between the abutting unit and the head portion.

5. The sleeve installer of claim 4, wherein the bearing assembly is mounted to the threaded rod and rotatable in place, and the bearing assembly is disposed between the head portion and the first abutting assembly.

6. The sleeve installer of claim 5, wherein the threaded rod further includes a non-threaded section and a threaded section, the non-threaded section is connected between the head portion and the threaded section, the second push member is screwed to the threaded section, the bearing assembly is disposed around the non-threaded section, and a restricting member is positioned on the non-threaded section so that the bearing assembly is restricted axially on the threaded rod.

7. The sleeve installer of claim 4, wherein the bearing assembly includes a first side disc, a middle disc and a second side disc which are arranged in the axial direction of the threaded rod, and the middle disc is rotatably abutted between the first side disc and the second side disc.

8. The sleeve installer of claim 1, wherein the first abutting assembly includes the first base portion and the support member, the support member is detachably assembled to the first base portion, and the support member is configured to be abutted against the sleeve assembly.

9. The sleeve installer of claim 8, wherein the first base portion includes a base plate, a projection and a fitting member which are arranged coaxially, the projection projects axially from the base plate, the fitting member projects radially from the projection, and the support member is disposed around the projection and abutted radially against the fitting member.

10. The sleeve installer of claim 6, wherein the first push member and the threaded rod are integrally formed of one piece; the second abutting assembly includes a second base portion and at least one wing, the at least one wing is disposed on the second base portion and extends in the axial direction of the threaded rod, and the at least one wing configured to be abutted against the tubular member; the bearing assembly includes a first side disc, a middle disc and a second side disc which are arranged in the axial direction of the threaded rod, and the middle disc is rotatably abutted between the first side disc and the second side disc; the first abutting assembly includes the first base portion and the support member, the support member is detachably assembled to the first base portion, and the support member is configured to be abutted against the sleeve assembly; the first base portion includes a base plate, a projection and a fitting member which are arranged coaxially, the projection projects axially from the base plate, the fitting member projects radially from the projection, and the support member is disposed around the projection and abutted radially against the fitting member; the first push member and the threaded rod are formed by cutting; the at least one wing includes two wings arranged symmetrically; the bearing assembly is radially higher than the first push member; the non-threaded section is radially larger than the threaded section, the non-threaded section is partially within the first abutting assembly; the restricting member is a c-shaped retainer; the fitting member is made of rubber; a through hole of the first base portion and a through hole of the second base portion are identical.

* * * * *